US007134152B1

(12) United States Patent
Batten et al.

(10) Patent No.: US 7,134,152 B1
(45) Date of Patent: Nov. 14, 2006

(54) ADAPTABLE, LOW COST AIR GAP AND FLOW CONTROL

(75) Inventors: William C. Batten, Asheboro, NC (US); Charles Kemp, Asheboro, NC (US); Bruce W. Kyles, Asheboro, NC (US)

(73) Assignee: Clearline Systems, Inc., Asheboro, NC (US)

( * ) Notice: Subject to any disclaimer, the term of this patent is extended or adjusted under 35 U.S.C. 154(b) by 134 days.

(21) Appl. No.: 10/738,436

(22) Filed: Dec. 17, 2003

(51) Int. Cl.
*E03C 1/12* (2006.01)

(52) U.S. Cl. ..... 4/679

(58) Field of Classification Search ..... 4/639, 4/640, 650, 679, 695, 696, 539
See application file for complete search history.

(56) References Cited

U.S. PATENT DOCUMENTS

| | | | | |
|---|---|---|---|---|
| 220,064 | A * | 9/1879 | Evans | 4/679 |
| 425,553 | A * | 4/1890 | Smith | 285/20 |
| 480,692 | A | 8/1892 | Clifford et al. | |
| 692,706 | A | 2/1902 | Poate | 4/640 |
| 1,183,568 | A | 5/1916 | Keevan | |
| 2,250,974 | A | 7/1941 | Stoddard | 137/21 |
| 2,878,826 | A | 3/1959 | Dolenga | 137/216 |
| 3,076,202 | A * | 2/1963 | Sorrells | 4/638 |
| 3,155,106 | A | 11/1964 | Baron | 137/216 |
| 3,236,482 | A * | 2/1966 | Fitzgerald | 248/62 |
| 3,455,324 | A | 7/1969 | Bieri et al. | 137/216 |
| 3,742,093 | A | 6/1973 | Skidmore | 260/893 |
| 3,872,017 | A | 3/1975 | Bishop | 210/525 |
| 3,957,637 | A | 5/1976 | Morey | 210/73 |
| 4,235,726 | A | 11/1980 | Skimo | 210/523 |
| 4,268,396 | A | 5/1981 | Lowe | 210/670 |
| 4,480,656 | A | 11/1984 | Johnson | 137/215 |
| 4,734,262 | A | 3/1988 | Bagshawe | 422/101 |
| 5,016,667 | A | 5/1991 | Tolf | 137/143 |
| 5,098,564 | A | 3/1992 | Miller et al. | 210/236 |
| 5,133,881 | A | 7/1992 | Miller et al. | 210/776 |
| 5,159,958 | A | 11/1992 | Sand | 137/888 |
| 5,178,754 | A | 1/1993 | Batten et al. | 210/138 |
| 5,271,853 | A | 12/1993 | Batten | 210/808 |
| 5,305,778 | A | 4/1994 | Traylor | 137/216 |
| 5,360,555 | A | 11/1994 | Batten | 210/803 |
| 5,405,538 | A | 4/1995 | Batten | 210/744 |
| 5,454,396 | A | 10/1995 | Hochstrasser | 137/218 |
| 5,482,621 | A | 1/1996 | Nurse | 210/170 |
| 5,492,619 | A | 2/1996 | Batten | 216/86 |
| 5,525,042 | A | 6/1996 | Batten | 417/113 |
| 5,543,064 | A | 8/1996 | Batten | 210/803 |
| 5,620,606 | A | 4/1997 | McBrayer, Jr. et al. | 210/696 |
| 5,678,592 | A | 10/1997 | Boticki et al. | 137/216 |
| 5,934,309 | A | 8/1999 | Batten | 137/216 |
| 5,948,279 | A | 9/1999 | Chang et al. | 210/808 |

(Continued)

FOREIGN PATENT DOCUMENTS

| | | |
|---|---|---|
| EP | 555672 A1 | 8/1993 |

(Continued)

*Primary Examiner*—Justine R. Yu
*Assistant Examiner*—Huyen Le
(74) *Attorney, Agent, or Firm*—MacCord Mason PLLC

(57) ABSTRACT

A kitchen sink installation includes a plurality of adjacent kitchen sinks having drain tailpieces, a manifold pipe mounted substantially horizontally under the sinks and having a length and a plurality of discrete openings along its length, each of the openings facing upward in alignment with and spaced by an air gap from one of the sink drain tailpieces, and an outlet at one end of the manifold pipe adapted to connect to a downstream flow direction of sink effluent.

16 Claims, 3 Drawing Sheets

U.S. PATENT DOCUMENTS

| | | | | |
|---|---|---|---|---|
| 5,951,878 | A | 9/1999 | Astrom | 210/791 |
| 6,019,894 | A | 2/2000 | Batten | 210/175 |
| 6,059,963 | A | 5/2000 | Horakova et al. | 210/143 |
| 6,213,002 | B1 | 4/2001 | Batten | 210/808 |
| 6,238,572 | B1 | 5/2001 | Batten | 210/739 |
| 6,261,462 | B1 | 7/2001 | Batten | 210/739 |
| 6,328,901 | B1 | 12/2001 | Batten | 210/774 |
| 6,368,501 | B1 | 4/2002 | Batten | 210/181 |
| 6,413,435 | B1 | 7/2002 | Kyles et al. | 210/800 |
| 6,435,078 | B1 | 8/2002 | Batten et al. | 99/446 |
| 6,453,487 | B1 * | 9/2002 | Babington | 4/619 |
| 6,478,552 | B1 | 11/2002 | Batten et al. | 417/393 |
| 6,491,830 | B1 | 12/2002 | Batten et al. | 210/803 |
| 6,517,715 | B1 | 2/2003 | Batten et al. | 210/232 |
| 6,576,140 | B1 | 6/2003 | Batten | 210/744 |
| 6,582,205 | B1 | 6/2003 | Batten et al. | 417/393 |
| 6,601,248 | B1 * | 8/2003 | Sage-Passant | 4/695 |
| 6,629,652 | B1 | 10/2003 | Batten | 241/24.11 |

FOREIGN PATENT DOCUMENTS

| | | | |
|---|---|---|---|
| GB | 2216821 | A | 10/1989 |
| SE | 678438 | A5 | 9/1991 |

* cited by examiner

ADAPTABLE, LOW COST AIR GAP AND FLOW CONTROL

BACKGROUND OF THE INVENTION

This disclosure relates to an assembly for receiving flows from a sink or other apparatus and, more particularly, to the prevention of a backflow, or back siphoning, in a fluid handling system. This apparatus, therefore, provides a connection that satisfies a minimum air-gap separation requirement. Also disclosed is a novel flow control fitting useful in the assembly and other applications.

In order to maintain sanitary conditions, plumbing and health code regulations require device drains to be individually drained with a flow passing through a minimum air space to preclude potential contamination caused by fluids migrating upstream due to a downstream blockage. Traditional air-gap connection methods have commonly used a pipe-and-cup arrangement. Effluent flows through a drain, passes through a mandated air-gap into a cup, and then passes through a pipe to a remote location. This conventional set-up requires an adequate vertical distance to be available. However, in many modern commercial kitchens, most devices discharge low to the floor and preclude such a pipe-and-cup design, particularly if other equipment needs to be installed downstream of the drain. A particular piece of equipment that may be installed downstream is the Big Dipper® grease separator sold by Thermaco, Inc. of Asheboro, N.C. Grease separators remove oil and grease from kitchen sink effluent so that the remaining effluent is easier to process, in compliance with many codes. The oil/grease separators have tanks with quiescent zones to permit the oil and grease to float on top of the water and be susceptible to removal. Such tanks need vertical height, which may not be available in traditional air-gap drains.

Applicant's prior U.S. Pat. No. 5,934,309 (Batten) discloses another apparatus and method for receiving flows from a multi-compartment sink, but this design has been found to have several drawbacks:

1) It has to be custom produced to fit the sink it is servicing.

2) It has custom produced sink tailpiece parts.

3) It has fabricated support brackets.

4) It is expensive to produce and therefore has an expensive price tag.

5) It is not very flexible (conducive) to on-the-spot field adaptations.

Providing an air-gap ahead of oil/grease separators is a major concern, particularly with the advent of the International Plumbing Code. As a result, there is a continuing need for an air-gap connection method that is low cost and works well, all while meeting situational space constraints.

SUMMARY OF THE INVENTION

The present invention fulfills one or more of these needs in the art by providing an apparatus for providing air gaps for sinks including a manifold pipe having a length and having a plurality of discrete openings along its length, each of the openings facing the same direction transverse to the length, a support bracket for the manifold pipe to suspend the manifold pipe substantially horizontally under the sinks so that the openings align with sink drain tailpieces, and an outlet at one end of the manifold pipe adapted to connect to a downstream flow direction of sink effluent.

In one embodiment the manifold pipe is made up of a plurality of sections including straight pipe sections and Tees, with the openings being openings in the Tees. The manifold pipe may have a second end that is closed.

The support bracket typically includes two supports for axially spaced locations of the manifold pipe. The support bracket may be made of hanger strap.

In a preferred embodiment the manifold pipe is about three inches in diameter and has an eccentric reducer at the outlet to a diameter of about two inches, so as to fit popular grease separator units. The eccentric provides alignment of a lower peripheral wall of the two inch diameter with a lower peripheral wall of the manifold pipe opposite the openings. This allows a common lower level for the pipe and a downstream pipe, so that effluent does not lie in the bottom of the manifold pipe. The manifold pipe can be sloped to direct the flow downstream.

The apparatus advantageously can include a drain flow control adapted to be installed on a sink drain tailpiece to collimate effluent flow from the tailpiece to direct the effluent flow to an opening in the manifold pipe aligned below the tailpiece. A preferred drain flow control is a one-piece elastomeric item configured with a circumferential band and a transverse disk at one edge of the band, the disk having a hole in it so that the effluent can pass through the hole when the control is mounted on the tailpiece. Preferably, the disk is axially distendable in response to an expected flow pressure, so as to take on a truncated conical configuration when distended. A band or clamp outside of the circumferential band may be used to secure the flow control to the tailpiece.

In some embodiments an oil/grease separator is downstream of the outlet.

The invention also provides a drain flow control adapted to be installed on a pipe to collimate effluent flow from the pipe to direct the effluent flow including a one-piece elastomeric item configured with a circumferential band and a transverse disk at one edge of the band, the disk having a hole in it so that the effluent can pass through the hole when the control is mounted on the pipe and being axially distendable in response to an expected flow, so as to take on a truncated conical configuration when distended. A band or clamp outside of the circumferential band may secure the flow control to the pipe.

The disk may have a reinforcing thickness surrounding the hole. The circumferential band may have an integral inner ridge to engage the band to a pipe inserted in the band. In a preferred embodiment the control is made of Buna N rubber and has a durometer of 45+/−5.

The invention also provides a kitchen sink installation including a plurality of adjacent kitchen sinks, each sink having a drain tailpiece, a manifold pipe mounted substantially horizontally under the sinks and having a length, a plurality of discrete openings along its length, each of the openings facing upward in alignment with and spaced by an air gap from one of the sink drain tailpieces, and an outlet at one end of the manifold pipe adapted to connect to a downstream flow direction of sink effluent.

The kitchen sink installation preferably includes drain flow controls installed on the sink drain tailpieces to collimate effluent flow from the tailpiece. The preferred drain flow controls each include a distendable disk extending transverse to a flow direction, the disk having a hole in it so that the effluent can pass through the hole as the disk distends in response to the flow, so as to take on a truncated conical configuration when distended and collimate the flow toward the opening in the manifold pipe.

The invention also provides a method of draining kitchen sinks including holding a volume of water in at least one of a plurality of adjacent kitchen sinks, draining the water from a drain at the bottom of the sink through a collimating drain flow control, exposing the collimated drained water to an air gap, collecting the drained water in an opening in a manifold pipe under the sink, and directing the drained water downstream of the manifold pipe.

Draining may include passing the water through a hole in a distendable disk that extends transverse to a flow direction and distending the disk, so the disk takes on a truncated conical configuration to collimate the flow. Preferably, rod-like solids in the drained water orient toward the flow direction at the conically configured disk.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Air-gaps are plumbed every day, but they ordinarily involve a nozzle (tailpiece) of smaller O.D. positioned 2" above a large diameter receiver, which is then coupled to at least one 90 degree elbow so as to orient the flow in a horizontal fashion. The component lengths add up so as to require 10" of vertical height to do what the preferred form of the present system can do in only 4" of vertical height (from the tailpiece to the centerline of the receiving horizontal manifold pipe).

Figure 1:
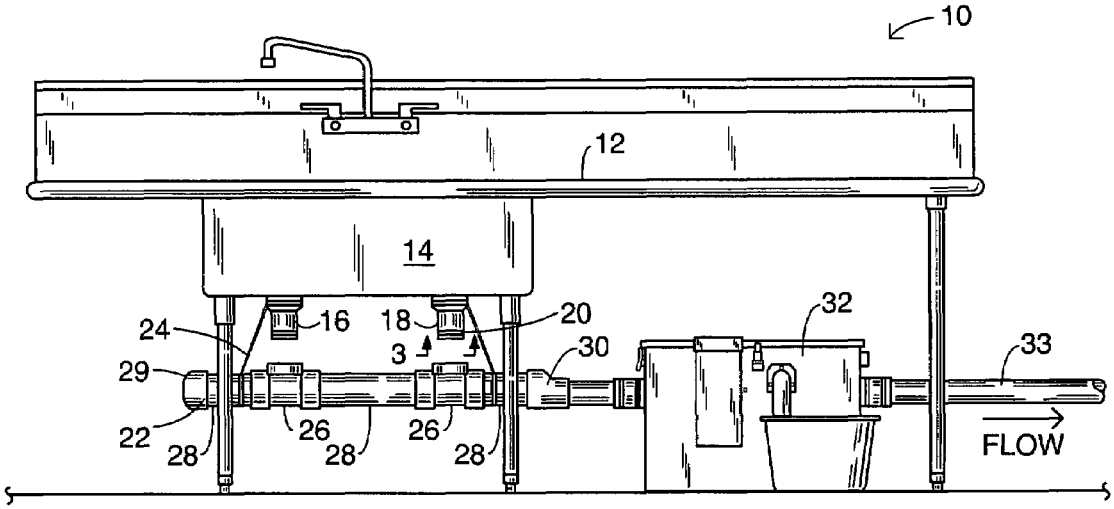
FIG. 1 is an elevation view of a preferred embodiment.

FIG. 1 shows an elevational view of an apparatus 10 in accordance with the invention. A counter 12 is provided with a plurality of sinks 14, or a single sink 14 with a plurality of tail pieces 16 and 18 through which water in the sink(s) can drain. Such tail pieces in sink installations are conventional. The bottom of each of the tail pieces is provided with a flow control 20, shown in more detail in FIG. 3 and discussed in further detail below. Spaced below the flow controls 20 is a manifold pipe 22. In order to be code compliant, the spacing to the top of the pipe 22 must be at least two inches. Other distances might be suitable for installations not requiring such code compliance. The manifold pipe 22 is made of conventional plumbing materials, such as PVC pipe of three inch internal diameter. In the embodiment seen in FIG. 1, the manifold pipe 22 is made up of a cap 29, three straight lengths 28 and two Tees 26. These components are assembled to provide a chamber having two side openings resulting from the side openings of the Tees 26, with those side openings facing the same side, and spaced apart the same distance as the center spacing of the tail pieces 16 and 18. Other installations may call for more or less Tees.

The manifold pipe 22 can then be substantially horizontally suspended by sink support brackets 24 which are made of conventional hanger strap material, well known to the plumbing trade. Typically, the upstream end of the manifold pipe 22 (the end having cap 29) will be suspended to a slightly higher elevation to provide drainage towards the downstream direction. Other forms of the support bracket such as a floor or wall mounted bracket can be used in place of the hanger strap.

At the downstream end of the manifold pipe 22 an eccentric coupling 30 couples the manifold pipe 22 to an inlet pipe of an oil/grease separator 32 which, in turn, discharges to a sanitary discharge 33. The discharge 33 defines a static water level in the oil/grease separator 32 which in turn define an appropriate inlet height for the coupling from the manifold pipe 22 to the oil/grease separator 32. In order to provide a quiescent volume in the separator 32, the inlet must be spaced above the floor, limiting how low the inlet can be located below the sinks 14. The bottom of the drain tail piece will be a particular distance from the floor and the difference in height between the bottom of the tail piece and the inlet to the separator must include the air gap. Prior art air gaps often are too big.

As seen in FIG. 1, by providing an eccentric coupling, the bottom wall of the three inch diameter manifold pipe 22 can be at the same elevation as the bottom wall of the two inch inlet coupling of the oil/grease separator 32. The use of a three inch diameter manifold pipe 22 is preferred to provide greater volume within the manifold pipe to receive and direct effluent from the tail pieces. Also, by using the standard Tee with a three inch diameter upwardly-facing opening, a larger target for the flow from the tail pipes is made.

Figure 2:
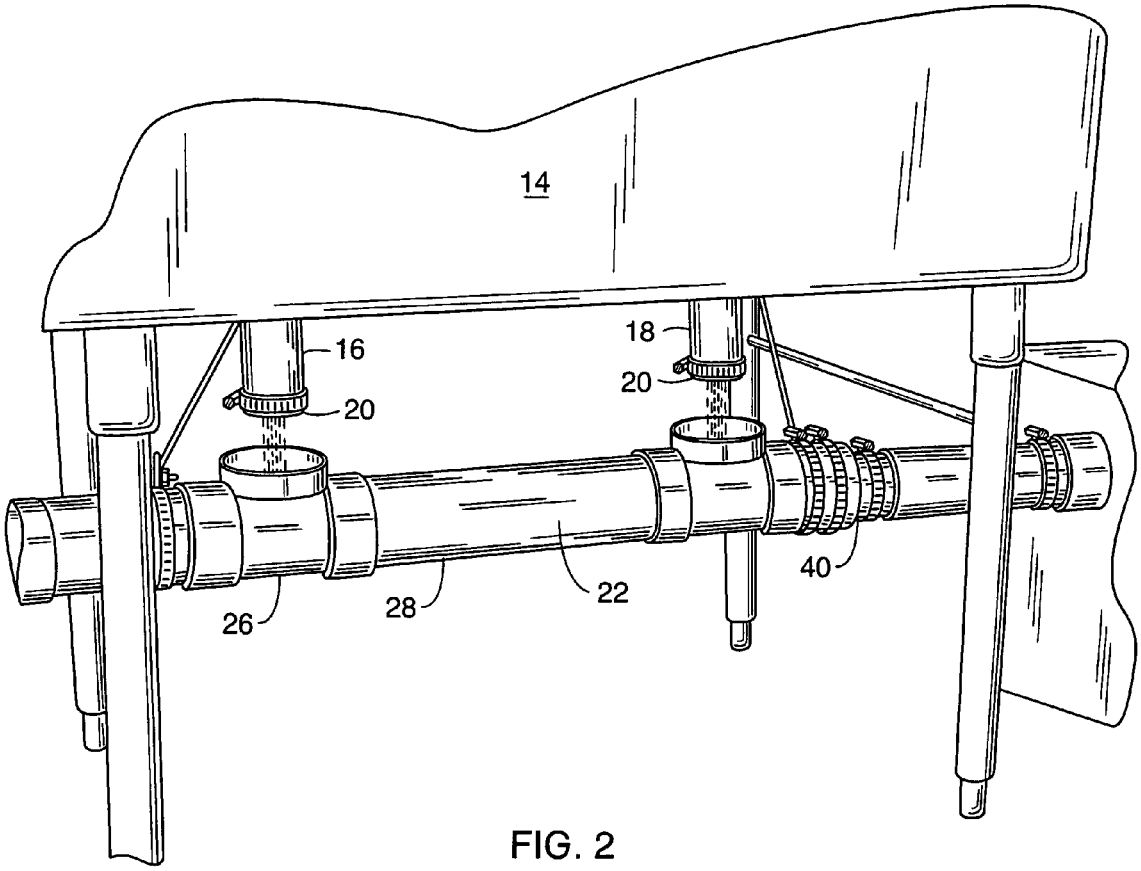
FIG. 2 is a perspective view of a similar embodiment.

FIG. 2 shows similar components, except that the coupling 40 is made concentric rather than eccentric, an alternate that is within the scope of the invention, but not preferred. However, FIG. 2 does show the collimated stream of water exiting the flow control 20, so as to be a relatively narrow column of water, which does not miss the target opening in the Tee. As can be appreciated, if there is a downstream blockage or a reversal of flow downstream, contaminated water cannot reach the sinks 14, because of the air gap between the tail pieces and the manifold pipe 22.

Figure 3:
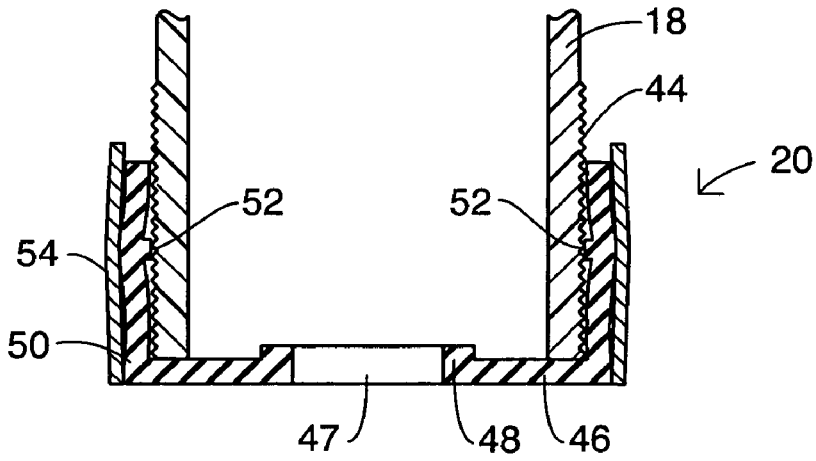
FIG. 3 is a partial sectional view of the embodiment of FIG. 1 taken along lines 3—3 and looking in the direction of the arrows.

FIG. 3 shows a sectional view of the flow control 20 mounted on the tail piece 18. In FIG. 3, the tail piece 18 is conventional and may have conventional threading 44. The flow control 20 is made up of a circumferential band 50 having at one edge a disk 46, such that the band 50 surrounds and engages the lower end of the tail piece 44, and the disk 46 closes off a substantial portion of the lumen of the tail piece 18 except for hole 47, preferably centrally located in the disk. The flow control 20 may be secured onto the end of the tail piece 18 with a band or clamp 54, which are well known in the art. Such couplings typically take the form of a metal band substantially encircling the pipe end and being subject to tightening by a screw extending from one end to the other, and being able to be tightened to reduce the ultimate diameter of the band, and to securely engage the tail piece and the encircling band 50 of the flow control 20. The band 50 may be provided with an inner rib 52 which encircles the tail piece 18 and provides a tighter grip. A thickened portion 48 on the disk surrounding the hole 47 provides reinforcement.

Preferably, the flow control 20 is made of buna-n rubber of a durometer of 45+/−5 as an integral item, in order to have the appropriate properties of durability and flexibility. However, other materials may be substituted. The flow control 20, by being bound to the end of the tail piece 18 constrains the flow to exit only through the hole 47. However, a pressure head in the column of water above the flow control 20 exerts pressure on the disk 46 and distends it downwardly to form a truncated conical shape with the narrower diameter being downward and the broader diameter of the cone being upward at the tail piece 18.

In operation, the flow thus distends the flow control into a conical configuration, which results in the collimation of the water flow (as seen in FIG. 2) and helps to maintain its direction into the open portion of the Tee 26. As the water collects in the Tee 26 as a component of the manifold pipe 22 it flows downstream through the coupling to the oil/grease separator 32. There, any grease components in the kitchen sink waste can be separated, so the remaining grey water can pass to the sanitary sewer 33.

The components used in my new air-gap are currently available in the plumbing industry, with the exception of the flow control that is secured to each sink tailpiece. The flow control orifice diameter can be sized to fit the sink situation (head height, rate of flow). Because the flow control is made from an elastomer, it contorts when receiving flow into a "conical" shape which aids in keeping the flow focused. That is, it keeps the flow oriented in a linear or collimated fashion versus exiting the orifice in a diffraction pattern. The conical shape is also useful for accommodating awkwardly shaped solids (rod-like solids orient in a conical flow control whereas they do not orient and pass through flat plate orifices).

The use of an eccentric reducer fitting as seen in FIG. 1 is a somewhat novel as that item is special ordered and seldom seen in use. FIG. 2 shows a conventional concentric reducer coupling. The eccentric coupling is preferred because it continues the slope of the pipe, which expedites flow. This reduces splashing because with a conventional 3" to 2" reducer coupling as shown in FIG. 2 there is 0.5" of standing water in the manifold pipe ahead of the coupling.

My new apparatus is simple and inexpensive, but no one else has figured out how to provide an air-gap and still deliver the flow into a standard grease interceptor.

The flow controller is a molded product that in some uses cooperates with a brass insert to fit internally of an inlet pipe. It can also fit on the outside of a pipe and be held in place with a No-Hub connector. In a flow control situation, whether in the apparatus described above, or other configurations of pipes, tubes and/or connections, the flow controller reduces the flow rate of the effluent liquid as it passes through the flow controller.

Figure 4:
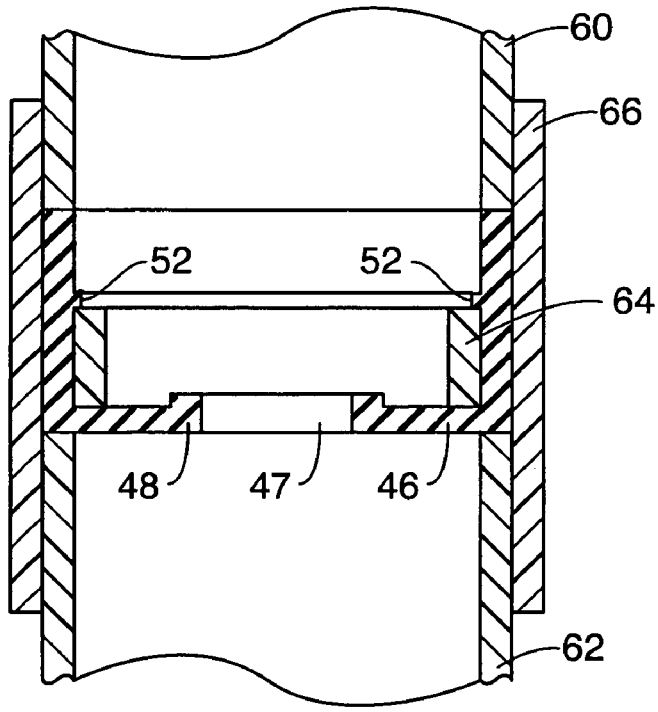
FIG. 4 is a sectional view of another installation using the flow control.

One such alternate use of the flow control 20 is seen in FIG. 4, a sectional view. A first pipe 60 is coupled to a second pipe 62 with the intervening flow control 20. A ring-shaped insert 64 is inserted within the flow control 20 between the rib 52 and the disk 46. Preferably, the ring 64 is brass, and provides resistance against radial crushing. As can be seen, the flow control band is sized to have the same outer diameter as the pipes 60 and 62. A no hub connector 66 that is larger than the connector 54 joins the aligned pipes and flow control. The flow control 20 limits the rate of flow between the joined pipes.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. An apparatus for providing air gaps for sinks comprising a manifold pipe having a length and having a plurality of discrete openings along its length, each of the openings facing the same direction transverse to the length, a support bracket for the manifold pipe to suspend the manifold pipe substantially horizontally under the sinks so that the openings align with sink drain tailpieces without contacting the sink drain tailpieces and thereby form airgaps, and an outlet at one end of the manifold pipe adapted to connect to a downstream flow direction of sink effluent.

2. An apparatus as claimed in claim 1 wherein the manifold pipe is made up of a plurality of sections including straight pipe sections and Tees, with the openings being openings in the Tees.

3. An apparatus as claimed in claim 1 wherein the manifold pipe has a second end that is closed.

4. An apparatus as claimed in claim 1 wherein the support bracket includes two supports for axially spaced locations of the manifold pipe.

5. An apparatus as claimed in claim 1 wherein the support bracket is made of hanger strap.

6. An apparatus as claimed in claim 1 further comprising a drain flow control adapted to be installed on a sink drain tailpiece to collimate effluent flow from the tailpiece to direct the effluent flow to an opening in the manifold pipe aligned below the tailpiece.

7. An apparatus as claimed in claim 1 further comprising an oil/grease separator downstream of the outlet.

8. An apparatus for providing air gaps for sinks comprising a manifold pipe having a length and having a plurality of discrete openings along its length, each of the openings facing the same direction transverse to the length, and a support bracket for the manifold pipe to suspend the manifold pipe substantially horizontally under the sinks so that the openings align with sink drain tailpieces, and an outlet at one end of the manifold pipe adapted to connect to a downstream flow direction of sink effluent, wherein the manifold pipe is about three inches in diameter and has an eccentric reducer at the outlet to a diameter of about two inches, the eccentric providing a lower peripheral wall of the two inch diameter to be aligned with a lower peripheral wall of the manifold pipe opposite the openings.

9. An apparatus for providing air gaps for sinks comprising a manifold pipe having a length and having a plurality of discrete openings along its length, each of the openings facing the same direction transverse to the length, and a support bracket for the manifold pipe to suspend the manifold pipe substantially horizontally under the sinks so that the openings align with sink drain tailpieces, and an outlet at one end of the manifold pipe adapted to connect to a downstream flow direction of sink effluent, wherein the manifold pipe has first diameter and has an eccentric reducer at the outlet to a reduced diameter, the eccentric providing a lower peripheral wall of the reduced diameter to be aligned with a lower peripheral wall of the manifold pipe opposite the openings.

10. An apparatus for providing air gaps for sinks comprising a manifold pipe having a length and having a plurality of discrete openings along its length, each of the openings facing the same direction transverse to the length, a support bracket for the manifold pipe to suspend the manifold pipe substantially horizontally under the sinks so that the openings align with sink drain tailpieces, an outlet at one end of the manifold pipe adapted to connect to a downstream flow direction of sink effluent, and a drain flow control adapted to be installed on a sink drain tailpiece to collimate effluent flow from the tailpiece to direct the effluent flow to an opening in the manifold pipe aligned below the tailpiece, wherein the drain flow control comprises a unitary elastomeric item configured with a circumferential band and a transverse disk at one edge of the band, the disk having a hole in it so that the effluent can pass through the hole when the control is mounted on the tailpiece.

11. An apparatus as claimed in claim 10 wherein the disk is axially distendable in response to an expected flow pressure, so as to take on a truncated conical configuration when distended.

12. An apparatus as claimed in claim 10 further comprising a band or clamp outside of the circumferential band to secure the flow control to the tailpiece.

13. An apparatus for providing air gaps for sinks comprising a manifold pipe having a length and made up of a plurality of sections including straight pipe sections and Tees having openings, to form a plurality of discrete openings along the length, each of the openings facing the same direction transverse to the length, two support brackets for axially spaced locations of the manifold pipe to suspend the manifold pile substantially horizontally under the sinks so that the openings align with sink drain tailpieces, and the manifold pipe having a first diameter and an eccentric reducer at the one end to a reduced diameter, the eccentric reducer providing a lower peripheral wall of the reduced diameter aligned with a lower peripheral wall of the manifold pipe opposite the openings and adapted to connect to a downstream flow direction of sink effluent.

14. An apparatus as claimed in claim 13 wherein the support bracket is made of hanger strap.

15. An apparatus as claimed in claim 13 further comprising a drain flow control adapted to be installed on a sink drain tailpiece to collimate effluent flow from the tailpiece to direct the effluent flow to an opening in the manifold pipe aligned below the tailpiece, wherein the drain flow control comprises a unitary elastomeric item configured with a circumferential band and a transverse disk at one edge of the band, the disk having a hole in it so that the effluent can pass through the hole when the control is mounted on the tailpiece and being axially distendable in response to an expected flow, so as to take on a truncated conical configuration when distended, and a band or clamp outside of the circumferential band to secure the flow control to the tailpiece.

16. An apparatus as claimed in claim 13 further comprising an oil/grease separator downstream of the eccentric reducer.

* * * * *

UNITED STATES PATENT AND TRADEMARK OFFICE

CERTIFICATE OF CORRECTION

PATENT NO. : 7,134,152 B1
APPLICATION NO. : 10/738436
DATED : November 14, 2006
INVENTOR(S) : Batten et al.

It is certified that error appears in the above-identified patent and that said Letters Patent is hereby corrected as shown below:

The correct title of the invention should be Adaptable, Low Cost Air Break And Flow Controller Signed and Sealed this Tenth Day of April, 2007

JON W. DUDAS
*Director of the United States Patent and Trademark Office*